United States Patent [19]

Henry

[11] Patent Number: 4,569,260

[45] Date of Patent: Feb. 11, 1986

[54] PLIERS-TYPE HAND TOOL

[75] Inventor: Kenneth E. Henry, Rocky Point, N.C.

[73] Assignees: Kenneth M. Henry; Daryl E. Henry; Kevin S. Henry all of Rocky Point, N.C.

[21] Appl. No.: 483,258

[22] Filed: Apr. 8, 1983

[51] Int. Cl.[4] ..... B25B 7/12

[52] U.S. Cl. ..... 81/378; 81/348; 81/349; 81/351; 81/363; 81/367

[58] Field of Search ..... 81/367–383.5, 81/342, 346, 415, 128, 348–351, 344, 354, 363, 416; 30/190–193, 251–252; 74/521

[56] References Cited

U.S. PATENT DOCUMENTS

| | | | |
|---|---|---|---|
| 146,829 | 1/1874 | Lindsay | 81/351 |
| 509,920 | 12/1893 | Lindsay | 81/348 |
| 832,804 | 10/1906 | O'Neal et al. | 30/191 X |
| 1,586,297 | 5/1926 | DuBois | 81/348 X |
| 1,860,290 | 5/1932 | Lebherz | 81/348 X |
| 2,035,686 | 3/1936 | Briegel | 81/349 X |
| 2,992,576 | 7/1961 | Evans et al. | 81/351 X |
| 3,091,841 | 6/1963 | Wurzel | 81/349 X |
| 3,422,708 | 1/1969 | Bieganski | 81/367 X |

FOREIGN PATENT DOCUMENTS

| | | | |
|---|---|---|---|
| 140044 | 1/1951 | Australia | 81/416 |
| 609702 | 10/1948 | United Kingdom | 30/251 |
| 1551033 | 8/1979 | United Kingdom | 30/191 |

*Primary Examiner*—Frederick R. Schmidt
*Assistant Examiner*—Debra S. Meislin
*Attorney, Agent, or Firm*—Harvey B. Jacobson

[57] ABSTRACT

A pliers-type hand tool has a pair of pivotally connected jaw-forming members defining jaw portions on one side of the pivot connection and elongate slotted lever portions on the other side of the pivot connection. A slide pin is received in the lever portion slots and is connected by pivot links to operating handles which are attached to the pivot connection in common with the jaw-forming members. The arrangement produces a mechanical advantage between the handles and the jaw-forming members allowing a greater jaw-closing force to be developed, related to the manual effort applied to the handles, than with conventional pliers-type tools of comparable size.

6 Claims, 5 Drawing Figures

10
12
14
16
18
20
22
24
26
28
32
34
40
42
44
46
48
50
52
54
56
4
5

10
12
14
16
22
24
26
28
32
36
40
42
44
46
48
54
56
3

26
28
44
50
52
58

16
18
20
46
48
50
52
54
56
58

22
24
36
38

PLIERS-TYPE HAND TOOL

BACKGROUND OF THE INVENTION

This invention relates to pliers-type hand tools. In a conventional tool of this type a pair of jaw-forming members are pivotally connected together so that each member provides a jaw portion on one side of the pivot and an elongate force-applying handle on the other side of the pivot. The amount of force which can be applied to the jaws in a tool of this form, related to the manual effort applied to the handles is limited by the leverage of the handles, and this is dependent on their length.

The present invention provides a novel pliers-type hand tool arrangement which enables increased leverage to be developed between the handles and the jaws as compared to a conventional form of tool of comparable size. Accordingly, an increased gripping force may be applied to the jaws related to the manual effort applied to the handles as compared to a conventional tool. While the invention will be described more specifically in relation to pliers, it is also considered applicable to other pliers-type hand tools having pivotal jaw-forming members, for example shears and the like.

STATEMENT OF PRIOR ART

Applicant is aware of the following U.S. patents showing pliers-type hand tools having various linkage arrangements between the handles and the jaws.

U.S. Pat. No. 146,829, Lindsay, 1-1874
U.S. Pat. No. 509,920, Lindsay, 12-1893
U.S. Pat. No. 832,804, Oneal et al, 10-1906
U.S. Pat. No. 1,586,297, Du Bois, 5-1926
U.S. Pat. No. 1,860,290, Lebherz, 5-1932
U.S. Pat. No. 2,035,686, Briegel, 3-1936
U.S. Pat. No. 2,992,576, Evans et al, 7-1961
U.S. Pat. No. 3,091,841, Wurzel, 6-1963
U.S. Pat. No. 3,422,708, Bieganski, 1-1969

SUMMARY OF THE INVENTION

In accordance with the present invention, a pliers-type hand tool has a pair of pivotally connected jaw-forming members each defining a jaw portion on one side of the pivot connection, and an elongated shank or lever portion on the other side of the pivot connection, the lever portions each being formed with a longitudinal track, e.g. a slot, and the tool including a follower mounted in the tracks for conjunctive sliding movement therein, toward and away from the pivot connection between the jaw-forming members. Further, the jaw-forming members have pivotally attached handles (conveniently these may be pivotally connected to the same pivot which connects the jaw-forming members) and the handles are each connected to the follower by pivotal links. The arrangement is such that when the handles are moved away from one another the follower is moved in the tracks toward the pivotal connection between the jaw-forming members, thereby serving to open the jaws, and conversely, when the handles are moved toward one another, the follower is moved in the tracks away from the pivotal connection, thereby serving to close the jaws. Due to the linkage arrangement provided between the handles and the lever portions, a mechanical advantage is developed so that a greater closing force related to manual effort applied to the handles is developed in the jaws compared to conventional tools of comparable size and the movable force applying point where the follower engages the lever portions of the jaw forming members provides for variation in the gripping or cutting force exerted on the jaw portions.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 2:
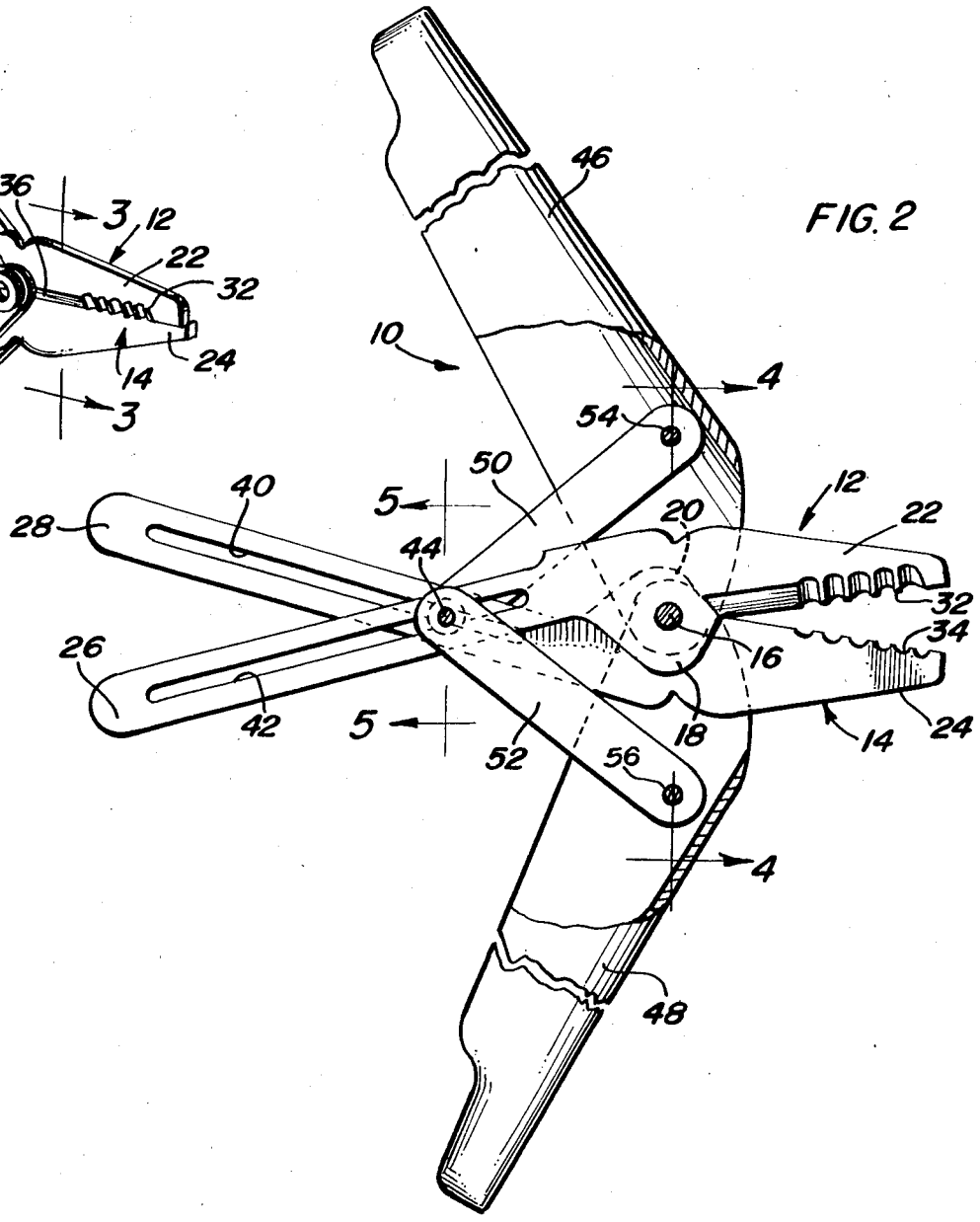
FIG. 2 is a front elevational view of the pliers, part broken away, and shown in open condition.
Figure 1:
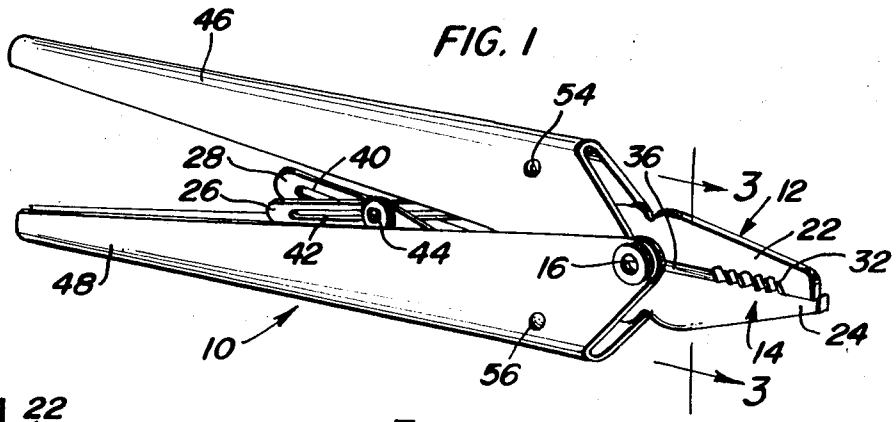
FIG. 1 is a perspective view of a pair of pliers or cutters in accordance with the invention, shown in substantially closed condition.

The illustrated pliers 10 comprises first and second jaw-forming members 12 and 14 respectively which are pivotally connected together by means of a pivot connection including a pivot pin 16 extending through suitable openings in complementary ear or lug portions 18, 20 of the respective members. The jaw-forming members have jaw portions 22, 24 on one side of the pivot connection, and elongate shank or lever portions 26, 28 on the other side of the pivot connection. The jaw portions may have complementary bevelled gripping or stripping sections 32, 34 and complementary bevelled cutting sections 36, 38.

The lever portions 26, 28 of the respective jaw-forming members have longitudinal tracks in the form of slots 40, 42, and a follower in the form of a slide pin 44 is mounted for conjunctive sliding movement along the trcks toward and away from pivot pin 16. It will be noted that as the slide pin moves towards pivot pin 16, the cross-over angle between lever portions 26, 28 increases and the jaw portions 22, 24 are mutually opened, while, as the slide pin is moved away from pivot pin 16, the cross-over angle between lever portions 26, 28 is decreased and jaw portions 22, 24 are moved toward one another.

Figure 5:
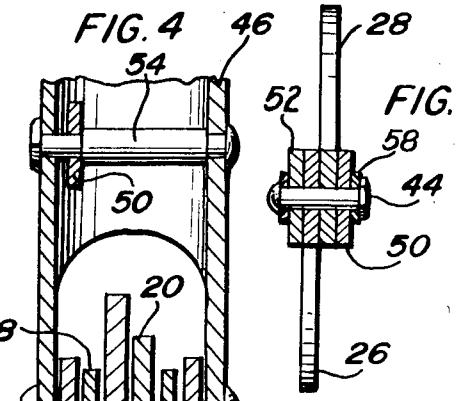
FIG. 5 is a sectional view on line 5—5 of FIG. 2.
Figure 4:
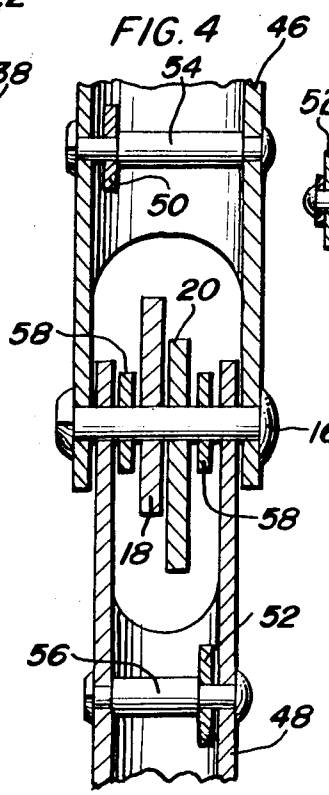
FIG. 4. is a sectional view on line 4—4 of FIG. 2.
Figure 3:
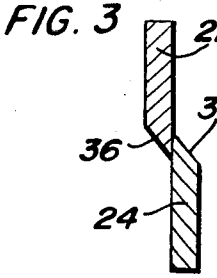
FIG. 3 is a sectional view on line 3—3 of FIG. 1.

To effect movements of slide pin 44 as described above, the pliers are provided with a pair of bifurcated elongate handles 46, 48. The handles are pivoted adjacent one end of each to pivot pin 16, which thus forms a common pivot for both the handles and the jaw-forming members. Further, handles 46, 48 are connected to slide pin 44 by links 50, 52 which are pivotally connected to the respective handles at their one end by rivets 54, 56 at locations on the handles spaced from pivot pin 16. At the other ends, links 50, 52 are pivoted to slide pin 44 outwardly of the lever portions 26, 28 (see FIG. 5). Both the pivot pin 16 and slide pin 44 have their ends headed over as shown in FIGS. 4 and 5. The arrangement is such that the bifurcated handles embrace the jaw-forming members and the links 50, 52, see FIG. 4. The items referenced 58 in FIGS. 4 and 5 are washers.

With the described arrangement, when the free ends of the handles are moved apart, slide pin 44 is caused to move in slots 40, 42 toward pivot pin 16, thereby opening the jaw portions 22, 24, while conversely, when the free ends of the handles are moved toward one another, slide pin 44 is caused to move in slots 40, 42 away from pivot pin 16, thereby closing the jaw portions. Further, due to the mechanical advantage afforded by the handle/link/slide pin/slot arrangement, the closing or gripping force of the jaw members related to the manual force applied to the handles is substantially increased compared with that available with conventional pliers of comparable size. Moreover, this increase in gripping force is achieved with relative simplicity in design and economy of parts. Further, the slide pin moving in the slots changes the length of the lever arm between the pivot connection 16 and the slide pin 44 where force is applied to the lever portions 26 and 28 thereby providing a variable mechanical advantage as the handles are moved in relation to each other.

It will be understood that the mechanical advantage afforded by the tool is dependent on the geometry of the various components and that the mechanical advantage may be altered with changes in the geometry. For example, one variable which affects the mechanical advantage is the spacing between pivot pin 16 and rivets 54, 56. Changing the spacing, may thus be effective in altering the mechanical advantage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pliers-type hand tool comprising first and second jaw-forming members, means providing a fixed pivot connection between said members, each jaw-forming member having a jaw portion on one side of the pivot connection and an elongate lever portion on the other side of the pivot connection, means defining a longitudinal track in each lever portion, a follower member mounted in the tracks for conjunctive sliding movement therein toward and away from said pivot connection to close and open the jaw portions respectively, a pair of operating handles pivotally connected to the jaw-forming members, and link means connected between each operating handle and said follower for effecting movement of the follower in said tracks toward said pivot connection responsive to separation of the handles and away from said pivot connection responsive to movement of the handles toward one another, wherein the handles are pivotally connected adjacent one end of each to said pivot connection, and wherein the link means comprises a link for each handle pivotally connected adjacent one end thereof to the respective handle at a location spaced from said pivot connection, and pivotally connected adjacent the other end thereof to the follower member.

2. A hand tool as claimed in claim 1 wherein the handles are bifurcated construction embracing the respective jaw-forming members and links.

3. A hand tool as defined in claim 1 wherein the tracks comprise longitudinal slots in the respective lever portions, and the follower member comprises a slide pin mounted in the slots.

4. A pliers-type hand tool comprising a pair of jaw-forming members each having a jaw portion and a lever portion, a pair of elongate operating handles, means providing a common fixed pivot connection between the handles and parts of the jaw forming members between the respective jaw portions and lever portions, and links pivotally connected to the respective handles, the links having a common sliding connection with the lever portions of the respective jaw-forming members for effecting opening movements of the jaw portions responsive to separation of the handles and closing movements of the jaw portions responsive to movement of the handles toward one another.

5. A hand-tool as defined in claim 4 wherein the lever portions of the jaw-forming members each define a longitudinal track and the tool includes a follower member mounted for conjunctive sliding movement in the tracks toward and away from said pivot connection, the links being pivotally attached to the follower member to form the common sliding connection.

6. A hand-tool comprising a pair of jaws, means pivotally connecting said jaws for movement toward and away from each other, a pair of handles, and means interconnecting the handles and jaws for moving the jaws toward and away from each other when the handles are moved in relation to each other and varying the force exerted on the jaws as the handles are moved toward and away from each other wherein said means interconnecting the handles and jaws includes a pivotal connection between each handle and the jaws, each jaw including a rigid extension, and linkage means extending between each of the handles and the extensions on the jaws for applying force to the jaws to move the jaws responsive to pivotal movement of the handles, said linkage means including a rigid link pivotally connected at one end to each handle in spaced relation to the pivotal connection between the handles and jaws, the other ends of said links being movably connected to said extensions for movement toward and away from the pivotal connection between the jaws, and wherein said extensions are elongate levers disposed in crossed relation and each is provided with a longitudinal slot, a slide pin in the crossed slots and connected with the ends of the links remote from the handles thereby providing a variable length lever arm as the handles are moved in relation to each other.

* * * * *